United States Patent [19]

Sheng

[11] Patent Number: 4,825,748

[45] Date of Patent: May 2, 1989

[54] HYDRAULIC ACTUATOR SYNCHRONIZATION APPARATUS AND SYSTEM

[75] Inventor: Shih Y. Sheng, Santa Anna, Calif.

[73] Assignee: Parker-Hannifin Corporation, Cleveland, Ohio

[21] Appl. No.: 69,460

[22] Filed: Jul. 2, 1987

[51] Int. Cl.[4] ..... F01B 25/04; F15B 11/22; F15B 13/00

[52] U.S. Cl. ..... 91/171; 91/510; 91/515; 91/517; 91/518; 91/528; 91/530

[58] Field of Search ..... 91/171, 189 R, 451, 91/452, 468, 509, 510, 514, 515, 517, 518, 528, 530

[56] References Cited

U.S. PATENT DOCUMENTS

| | | | |
|---|---|---|---|
| 2,270,943 | 1/1942 | Freundel et al. | 91/528 X |
| 2,423,264 | 7/1947 | Stephens | 91/514 X |
| 2,969,647 | 1/1961 | Raymond | 91/181 X |
| 3,262,740 | 7/1966 | Stockwell | 91/171 X |
| 3,355,993 | 12/1967 | Williamson | 91/171 |
| 4,599,856 | 7/1986 | Araki et al. | 91/516 X |

FOREIGN PATENT DOCUMENTS

| | | | |
|---|---|---|---|
| 511479 | 6/1952 | Belgium | 91/517 |
| 226356 | 1/1967 | U.S.S.R. | 91/171 |
| 236936 | 11/1969 | U.S.S.R. | 91/171 |

*Primary Examiner*—Robert E. Garrett
*Assistant Examiner*—Mark A. Williamson
*Attorney, Agent, or Firm*—Ralph E. Jocke

[57] ABSTRACT

A system reduces force fight between hydraulic actuators (22, 24) operated on independent hydraulic circuits (29, 49) which position a control surface (20) of an aircraft. Each circuit includes a hydraulic supply (30, 50). A pressure equalization valve (70) is connected to first sides (42, 62) of the actuators. In the event of a pressure imbalance, a spool (82) shifts in the pressure equalization valve. Movement of the spool enables fluid from the circuit supply to be delivered through the equalization valve to the actuator at the lower pressure, rapidly eliminating the imbalance.

26 Claims, 9 Drawing Sheets

HYDRAULIC ACTUATOR SYNCHRONIZATION APPARATUS AND SYSTEM

TECHNICAL FIELD

This invention relates to hydraulic systems. Specifically, this invention relates to hydraulic systems which employ a plurality of synchronized actuators to position a control surface of an aircraft.

BACKGROUND ART

Aircraft are controlled in the air through movement of ailerons, flaps, rudders and other control surfaces. In many aircraft, the control surfaces are moved by hydraulic actuators. Often, because of dimensional constraints or the force required, more than one actuator is used to position a control surface. When hydraulic actuators operate in parallel on a single control surface, their movement must be closely synchronized. When the actuators lose synchronization, they work against each other and a condition known as "force fight" results. Force fight is detrimental because it stresses the control surface structure. The stress caused by force fight can fatigue the control surface structure and may result in premature failure.

Another reason that parallel actuators are used in aircraft to operate control surfaces is to provide redundancy. It is common to operate each actuator on an independent hydraulic circuit. This way, if a hydraulic system fails, the remaining system can still be used to position the control surface and operate the aircraft. The use of independent hydraulic systems to operate a control surface increases the instances of force fight. Force fight occurs due to differences in the components which make up the parallel systems. These differences may result from manufacturing variations in the valve's or actuator's uneven wear, obstructions in hydraulic lines or differences in the electrical or other signals which actuate hydraulic flow control valves. These differences can cause one actuator to respond faster than another resulting in undue stress to the control surface as it is moving to a final position. The problem is particularly severe when the hydraulic systems are called on to respond as rapidly as possible.

Force fight may also occur when one hydraulic system becomes inoperative. The inoperative system resists the operative system's efforts to move the control surface which again results in undue stress.

One of the approaches previously used to reduce the problem of force fight on control surfaces is to use tandem or "in-line" actuators to operate each ram or shaft which positions a control surface. This approach places the stress of the hydraulic imbalance on the common shaft rather than on the control surface. The problem with this approach is that there is a weight penalty associated with the use of redundant hydraulic systems in a single tandem assembly. In addition, because an actuator from each independent hydraulic system must be tied to each shaft or ram, such systems cannot be practically used where more than two actuators are used to position a controlled surface.

Another proposed solution to solving the problem of force fight is to employ electronic pressure sensors on the ports of the parallel actuators to monitor pressure. The sensors are connected to a computer processor which is programmed to adjust the electrical signals to the control valves to equalize the pressure. The problem with this approach is that the system has to be constantly self-adjusting. This makes the programming for such a system exceedingly complex. The required sensors and other components makes such a system expensive to implement. In addition, such a system could not prevent force fight from occurring in full control situations where maximum fluid flow to each actuator is desirable.

Thus, there exists a need for a system for preventing force fight which is more reliable, lower in weight, and less expensive to implement than prior systems. Further, there exists a need for a hydraulic pressure equalization apparatus which can be used in a system for reducing force fight on the control surfaces of aircraft.

DISCLOSURE OF INVENTION

It is an object of the present invention to provide a synchronization system for parallel hydraulic actuators which reduces both static and transient pressure imbalances between said actuators.

It is a further object of the present invention to provide a synchronization system for parallel hydraulic actuators which is more reliable, lower in weight, and less expensive to implement than existing systems.

It is a further object of the present invention to provide a synchronization system for parallel hydraulic actuators, each of which is operated on a separate hydraulic system.

It is a further object of the present invention to provide a synchronization system for parallel hydraulic actuators operating on separate hydraulic systems for positioning the control surface of an aircraft which enables the continued positioning of the control surface if one of the systems fails.

It is a further object of the present invention to provide a synchronization system for parallel hydraulic actuators which position the control surface of an aircraft, which reduces the stress in said control surface due to force fight.

It is a further object of the present invention to provide a pressure equalization apparatus for equalizing pressure between parallel hydraulic actuators.

It is a further object of the present invention to provide a pressure equalization apparatus which is more reliable, lower in weight, and less expensive.

It is a further object of the present invention to provide a pressure equalization apparatus which is settable to be inactive below a threshold differential pressure.

It is a further object of the present invention to provide a pressure equalization apparatus for parallel hydraulic systems which isolates a hydraulic system in the event it fails.

Further objects of the present invention will be made apparent in the following best modes for carrying out the invention and the appended claims.

The foregoing objects are accomplished by a system for equalizing pressure between hydraulic actuators acting in concert to position the control surface of an aircraft. The system includes a first hydraulic supply and a second hydraulic supply. The first supply provides hydraulic fluid through an electrohydraulic control valve to a first hydraulic actuator. The second supply provides hydraulic fluid through a second electrohydraulic control valve to a second hydraulic actuator. The electro-hydraulic control valves transmit pressure to the actuators in response to electronic signals from the control system used to maneuver the aircraft operated by the pilot.

The hydraulic actuators each have an output ram which is connected by connecting means to a control surface of the aircraft. The hydraulic actuators each have an internal piston. Hydraulic pressure is applied to a first side of the piston to move the actuator and the control surface in a first direction.

The system includes a pressure equalization valve. The pressure equalization valve has a spool fitting in close tolerance within a sleeve and moveable therein. The ends of the sleeve are closed by cap portions at each end. First and second compartments are defined in the sleeve distally at the ends of the spool. A first cylinder is mounted for movement in the first compartment. A second cylinder is mounted for movement in the second compartment. The cylinders include means for passing fluid to and from the spool. A pair of opposed springs act on each cylinder and bias the spool to a neutral center position in the sleeve.

The sleeve has a first inlet which is in fluid connection directly with the first hydraulic supply. The spool incorporates a first fluid passage for passing fluid from the first inlet to the first compartment when the inlet and first passage are aligned in the sleeve. However, when the spool is in the neutral position, the first passage is located distally outward of the first inlet. The first compartment is in fluid connection with the first side of the piston of the first actuator.

The valve also has a second inlet which is in fluid connection with the second hydraulic supply. The spool also incorporates a second fluid passage for passing fluid from the second inlet to the second compartment when the second inlet and second passage are aligned in the sleeve. However, when the spool is in the neutral position, the second passage is located distally outward of the second inlet. The second compartment is in fluid connection with the first side of the piston of the second actuator.

When pressure is applied to the first sides of the actuators through operation of the electro-hydraulic control valves, the pressure rises correspondingly in the first and second compartments of the pressure equalization valve. If the pressures remain the same, the spool remains at the neutral position and the valve is inoperative. If pressure becomes greater in one of the actuators, due to a transient imbalance, the spool moves toward the compartment corresponding to the actuator at the lower pressure. The movement of the spool applies some additional pressure on the actuator at the lower pressure. If the pressure imbalance continues to grow and becomes sufficiently large, the spool moves to align the inlet and fluid passage corresponding to the actuator at the lower pressure. This causes pressure to be applied through the pressure equalization valve directly from the hydraulic supply for the actuator at the lower pressure to the actuator. This compensates for the deficiency in pressure transmission on the fluid path through the electro-hydraulic valve, equalizes the pressures in the actuators rapidly and avoids force fight. As soon as the pressures equalize in the actuators, the spool moves back to the neutral position.

In the event one of the hydraulic systems fails and loses its pressure, the spool of the pressure equalization valve is forced all the way toward the compartment associated with the failed system. Stops on the spool cause the inlet and passage of the failed system to be aligned in this condition. Thus, fluid is free to flow from the actuator on the failed system through the pressure equalization valve. This prevents the actuator from dragging and causing force fight with the actuator on the system still in operation. In an alternative embodiment, the pressure equalization valve is constructed so the spool of the valve does not align the inlet and fluid passage for a failed system. This tends to hold the actuator in position. Such a configuration is used for control surfaces where dragging by a failed system is desirable.

BEST MODES FOR CARRYING OUT INVENTION

Figure 1:
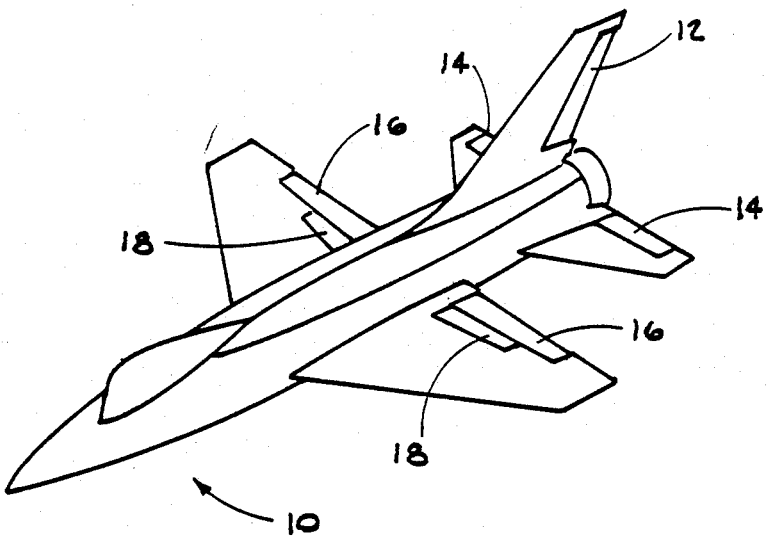
FIG. 1 is the view of an aircraft showing the control surfaces.

Referring now to the drawings, and particularly to FIG. 1, there is shown therein an aircraft generally indicated 10. Aircraft 10 has a rudder 12, elevators 14, ailerons 16 and spoilers 18. These surfaces of the aircraft are positioned during flight to maneuver in the air and are collectively referred to as control surfaces. Sophisticated aircraft have many control surfaces on the wings and airframe.

Figure 2:
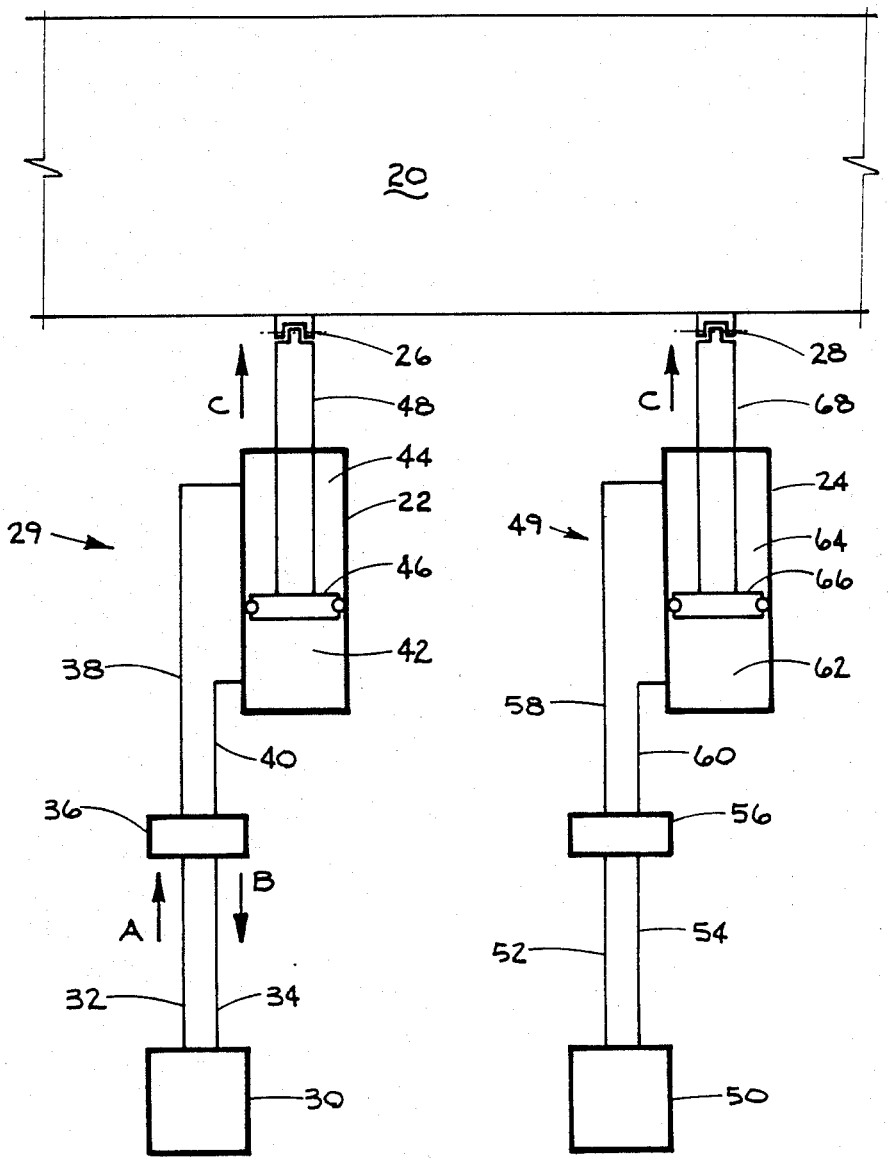
FIG. 2 (PRIOR ART)
FIG. 2 is a schematic view of an aircraft control surface positioning control system having two parallel hydraulic systems.

The movement of the control surfaces must be controlled precisely. In many aircraft, hydraulic actuators are used to move the control surfaces. A schematic of a system for a moving control surface 20 is shown in FIG. 2. The system includes a pair of hydraulic linear actuators 22, 24. The actuators are connected to the control surface by connecting means 26, 28. Although the actuators shown in FIG. 2 are linear actuators, for other control surfaces rotary or other types of hydraulic devices may be used.

The operating fluid for actuator 22 is supplied from a first hydraulic system circuit generally indicated 29. System 29 includes a hydraulic supply 30. Supply 30 may typically consist of a pump and a fluid reservoir. Supply 30 supplies fluid at high pressure to a supply line 32 and receives fluid back at low pressure in a return line 34. Arrows A and B show the direction of fluid flow in lines 32 and 34 respectively. Lines 32 and 34 are connected to an electro-hydraulic control valve 36. Control valve 36 is connected to actuator 22 by a pair of actuator feed lines 38 and 40. Line 40 is in fluid connection with a first side 42 of hydraulic actuator 22. Line 38 is in fluid connection with a second side 44 of actuator 22. Sides 42 and 44 are separated by a piston 46 inside actuator 22.

Control valve 36 is operates to regulate fluid flow and pressure in feed lines 38 and 40 and thus control fluid pressure on first and second sides 42 and 44 of actuator 22. By enabling the flow of hydraulic fluid into first side 42 and enabling flow of fluid out of second side 44, actuator ram 48 which is connected to piston 46, is moved in the direction of arrow C. Ram 48 is connected by connecting means 26 to control surface 20. Thus, the movement of ram 48 in a first direction correspondingly moves control surface 20 in a first direction. By changing the condition of control valve 36, the fluid pressure applied to first and second sides 42 and 44 of cylinder 22 can be reversed to move ram 48 in the opposite direction. Control valve 36 is responsive to electrical signals supplied to said valve from the control system of the aircraft operated by the pilot.

Actuator 24 is supplied from a separate hydraulic system circuit generally indicated 49, operated in parallel with system circuit 29. System 49 includes a second hydraulic supply 50, hydraulic supply and return lines 52 and 54 respectively, a second electrohydraulic control valve 56 and supply lines 58 and 60 connected to actuator 24. Actuator 24 has a first side 62 and a second side 64 which are separated inside the actuator by a piston 66. Piston 66 is connected to a ram 68 which is connected through connecting means 28 to control surface 20. Control valve 56, like control valve 36, is operated by electrical signals it receives from the control system of the aircraft. The electrical signals to valves 36 and 56 have a predetermined relationship so that rams 48 and 68 of actuators 22 and 24 operate in coordination.

Although the hydraulic systems 29 and 49 which supply actuators 22 and 24 are intended to operate in synchronization, it is not possible to perfectly match the performance of the systems. This is due to slight differences in the components of the systems. Even though the electrical signals supplied to control valves 36 and 56 may be fully coordinated, rams 48 and 68 may attempt to move at different speeds or to different positions. This causes control surface 20 to distribute the fighting forces from the actuators so as to unduly stress the control surface between connecting means 26 and 28 where the forces are applied.

Figure 3:
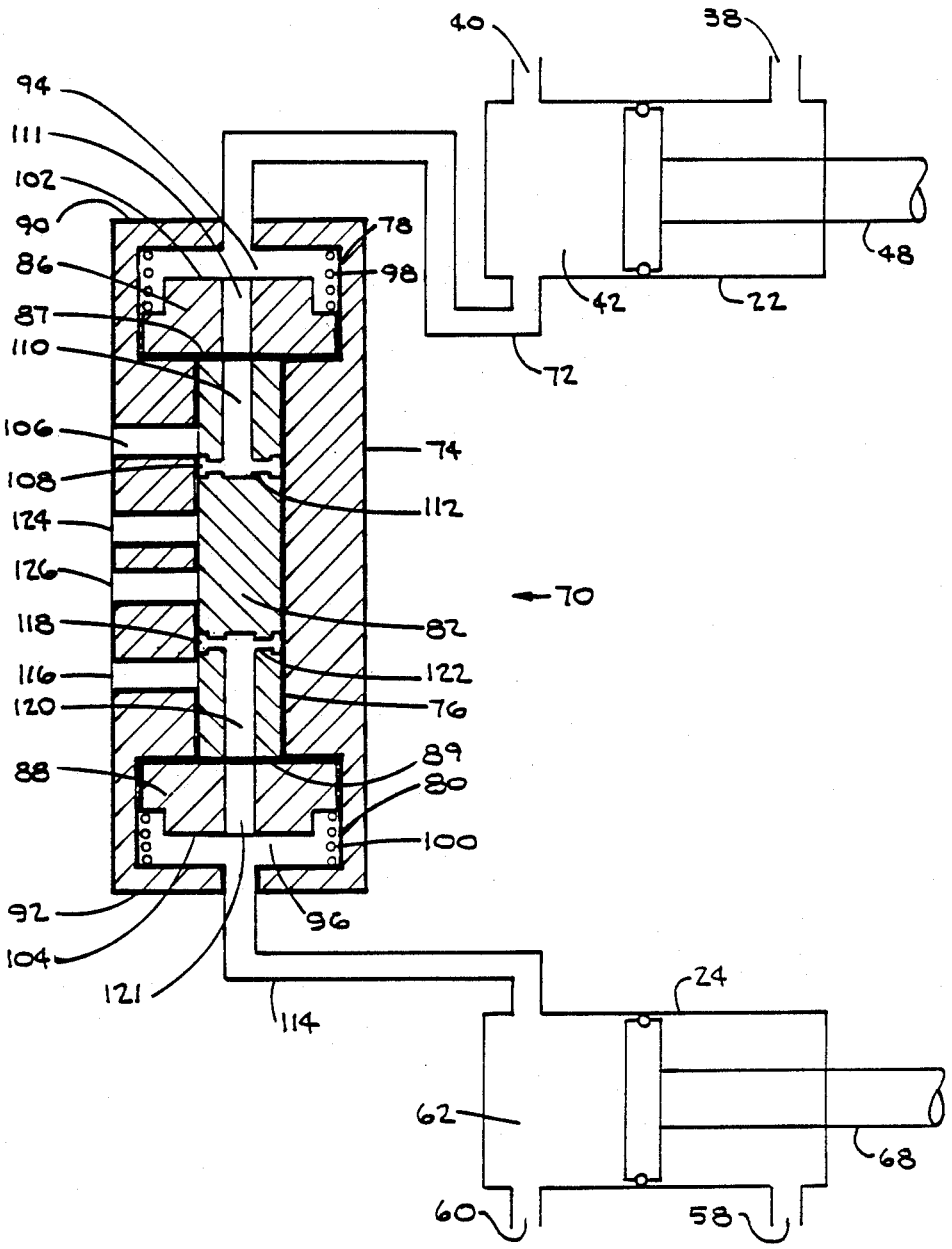
FIG. 3 is a schematic view of the preferred embodiment of the hydraulic actuator synchronization system of the present invention and a sectioned view of a first embodiment of the pressure equalization valve of the present invention.

The preferred form of Applicant's invention for synchronizing hydraulic actuators is shown in FIG. 3. A pressure equalization valve generally indicated 70, is connected by a line 72 which serves as first fluid connecting means to first side 42 of actuator 22. Pressure equalization valve 70 includes a body 74 incorporating a longitudinal cylindrical sleeve 76. Distally outboard of said sleeve in a first direction is a first cylindrical open area 78 and distally outboard said sleeve in the opposite direction is a second cylindrical open area 80.

A spool 82 is positioned inside body 74. Spool 82 is in close tolerance with sleeve 76 and is moveable longitudinally therein. The length of spool 82 approximates that of sleeve 76 and is slightly shorter than said sleeve. A first cylinder 86 is positioned in area 78 adjacent a first end 87 of said spool. A second cylinder 88 is positioned in area 80 adjacent a second end 89 of said spool. First cylinder 86 has a periphery sized to be in close tolerance with first open area 78 and is moveable longitudinally outward therein. Similarly, cylinder 88 is sized in close tolerance with second open area 80 and is moveable longitudinally outward therein. Body 74 incorporates end cap portions 90, 92 which serve as closure means at each end. A first compartment 94 is formed in the valve in the area between first cylinder 86 and cap 90. First fluid connecting means 72 is connected to first compartment 94. Similarly, a second compartment 96 is defined in the valve between second cylinder 88 and cap 92.

A coil spring 98 is positioned in first compartment 96 between cap 90 and cylinder 86. A coil spring 100 is positioned in second compartment 96 between cap 92 and cylinder 88. Springs 98 and 100 act as biasing means on spool 82 and bias the spool to a neutral centered position in sleeve 76. Cylinders 86 and 88 incorporate extending portions 102, 104 respectively of lesser diameter than the main portions of the cylinder. Extending portions 102, 104 serve to hold the proximal ends of springs 98 and 100 in position. In addition, extending portions 102, 104 serve as stop means for controlling the extent of lateral movement of spool 82 as later explained.

Pressure equalization valve 70 has a first inlet 106 which extends through body 74 and sleeve 76 to the area of spool 82. Inlet 106 is connected by second fluid connecting means (not shown) to supply line 32 of supply 30. Spool 82 incorporates a circumferential trough 108. Spool 82 also incorporates a longitudinal hole 110 from first end 87 to the level of trough 108. Cylinder 86 also incorporates a hole 111. A plurality of radial holes 112 connect trough 108 to axial hole 110. Trough 108, radial holes 112, axial hole 110, and cylinder hole 111 serve as first fluid passage means for passing fluid from inlet 106 to first compartment 94 when inlet 106 and trough 108 are aligned. When inlet 106 and trough 108 are not aligned, flow is blocked due to the close tolerance between the spool and sleeve.

Valve 70 is connected to first side 62 of actuator 24 by third fluid connecting means 114 which connects to second compartment 96 of said valve. Valve 70 also incorporates a second inlet 116 which extends through body 74 and sleeve 76. Inlet 116 is connected by fourth fluid connecting means (not shown) to supply line 52 of hydraulic supply 50.

Spool 82 incorporates a second circumferential trough 118. A second longitudinal axial hole 120 extends through spool 82 from second end 89 to the level of trough 118. A plurality of radial holes 122 connect trough 118 and hole 120. Cylinder 88 incorporates a hole 121. Trough 118, radial holes 122, axial hole 120, and cylinder hole 121 serve as second fluid passage means from inlet 116 to second compartment 96 when trough 118 and inlet 116 are in alignment. When trough 118 and inlet 116 are not aligned, fluid flow is inhibited.

Pressure equalization valve 70 incorporates a first return 124 which extends through body 74 and sleeve 76. Return 124 is in fluid connection with return line 34 of hydraulic supply 30. Pressure equalization valve 70 also incorporates a second return 126 which extends through body 74 and sleeve 76. Return 126 is in fluid connection with return line 54 of hydraulic supply 50. Returns 124 and 126 serve to collect hydraulic fluid that leaks between sleeve 76 and spool 82. As return 124 is positioned closest in the sleeve to inlet 106, fluid leaking in sleeve 76 from hydraulic supply 30 will be returned to supply 30. Likewise, the position of return 126 in sleeve 76 assures that fluid from second hydraulic supply 50 is returned to it. This configuration minimizes cross leakage between the parallel hydraulic systems.

As shown in FIG. 3, when pressure equalization valve 70 is in the neutral position, spool 82 is centered in sleeve 76. In this position, trough 108 is positioned longitudinally inward of inlet 106 and trough 118 is positioned longitudinally inward of inlet 116. Thus, in the neutral position, no fluid flows through the valve. Spool 82 remains in the neutral position and no fluid flow occurs as long as the pressures in first compartment 94 and second compartment 96 remain approximately the same. Because compartments 94 and 96 are in communication with first sides 42 and 62 of actuators 22 and 24 respectively, the pressures in the compartments correspond to the pressures in the first sides of the actuators. When pressures in the first sides are equal the systems are in balance. In the balanced condition, no force fight occurs and pressure equalization valve 70 does not operate.

In the preferred form of the invention, the surface areas of the faces of first end 87 and second end 89 are identical. The force exerted on each end of the spool by fluid pressure in the compartments is the same when the pressures are balanced. In other embodiments it may be desirable to use different surface areas at the ends of the spool so the spool is in the neutral position when the pressures are uneven.

Figure 4:
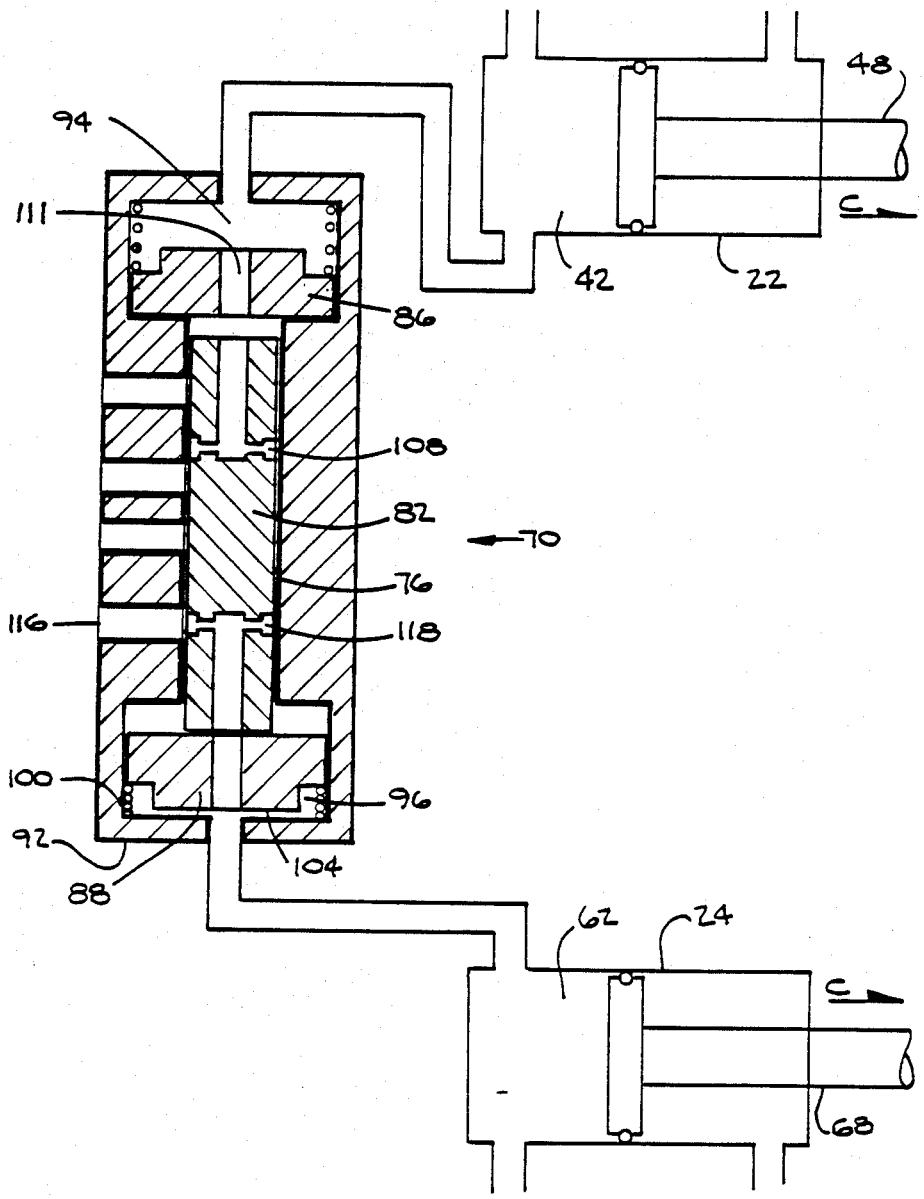
FIG. 4 is a view similar to FIG. 3 showing the pressure equalization valve in a first acting condition.

FIG. 4 demonstrates pressure equalization valve 70 in operation. In the situation shown in FIG. 4, fluid pressure is applied through control valves 36, 56 to first sides 42 and 62 of actuators 22 and 24. The pressure moves the rams 48 and 68 in the direction of arrow C. Due to differences in the parallel hydraulic systems, the pressure on first side 42 rises more rapidly than the pressure on first side 62. Without the pressure equalization system of the present invention, such imbalance would cause force fight. However, the increased pressure inside 42 causes a corresponding pressure increase in first compartment 98. The increased pressure acting through cylinder hole 111 causes spool 82 to move longitudinally pushing cylinder 88 outward against the biasing force of spring 100. This raises the pressure in second compartment 96 slightly. A pressure imbalance of sufficient magnitude causes spool 82 to move to the position shown in FIG. 4. For this condition, inlet 116 is aligned with trough 118 and high pressure fluid from supply 50 flows through valve 70 to rapidly raise the pressure in first side 62. As fluid pressure is applied to first side 62, trough 108 which is in fluid connection with the first compartment 94 of the valve which is at the higher pressure remains blocked by sleeve 76 so no pressure is lost from first side 42. As the pressure differential between first sides 42 and 62 is eliminated, the increase in pressure in second compartment 96 moves cylinder 88 and spool 82 back to the neutral position shown in FIG. 3. This causes inlet 116 and trough 118 to no longer be aligned, stopping fluid flow.

Figure 5:
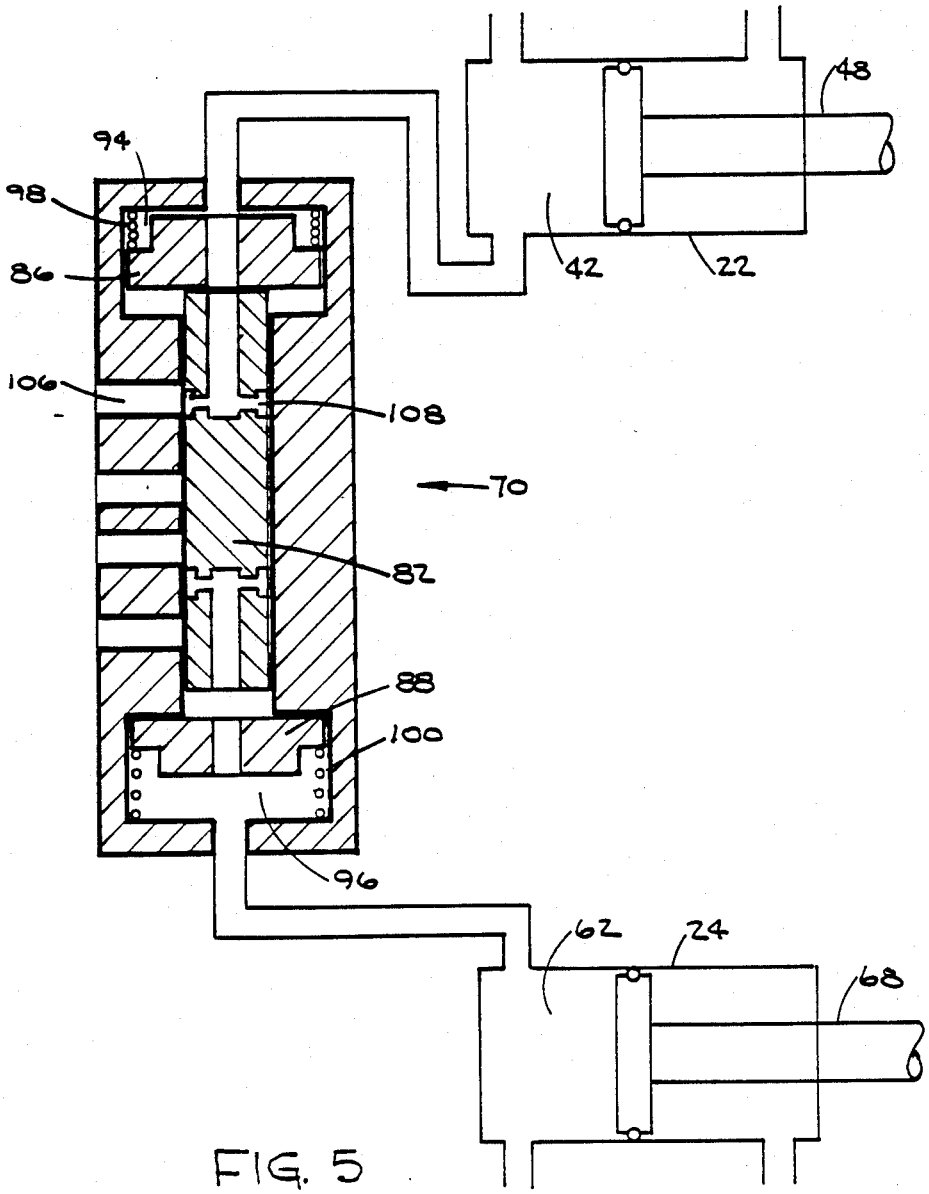
FIG. 5 is a view similar to FIG. 3 showing the pressure equalization valve in a second acting condition.
Figure 6:
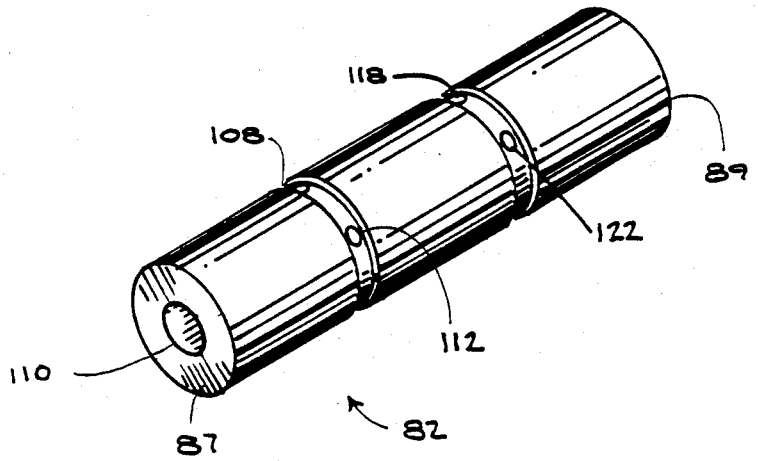
FIG. 6 is an isometric view of the spool of the first embodiment of the pressure equalization valve.

FIG. 5 shows pressure equalization valve 70 in operation for the condition opposite that shown in FIG. 4. In FIG. 5, the valve is shown for the condition where the pressure in first side 62 of actuator 24 exceeds that in first side 42 of actuator 22. In this situation the pressure increases in second compartment 96 causing spool 82 to move upward in FIG. 5 against the biasing force of spring 98. Sufficient movement of spool 82 causes trough 108 and inlet 106 to be aligned which applies fluid directly from supply 30 to first side 42, equalizing the pressure in the actuators and avoiding force fight. As the pressure equalizes, spool 82 returns to the neutral position of FIG. 3 and flow through pressure equalization valve 70 stops.

The degree of pressure in balance between the actuators sufficient to cause pressure equalization valve 70 to operate is determined by the magnitude of the center biasing force applied to spool 82 by springs 98 and 100. The greater the center biasing force exerted by the springs on the spool, the greater the imbalance between the actuators must be before the valve initiates operation. In the preferred form of the invention, pressure equalization valve 70 is set to operate when the pressure differential exceeds 50 psig.

Another situation in which force fight occurs is when one of a pair of hydraulic systems fails. In this circumstance, the "dead" fluid in the inoperative hydraulic system acts to hold the control service in its then existing condition. The dead system fights efforts by the operative system to move the control surface. The system of the first embodiment of the present invention minimizes force fight under these circumstances. In the event hydraulic supply 50 loses its pressure, the pressure in first side 62 of actuator 24 drops below that in first side 42 of actuator 22, causing spool 82 of valve 70 to move to the position shown in FIG. 4. In this condition, no pressure equalization occurs because no pressure is available at inlet 116. Spool 82 is forced downward until extending portion 104 of cylinder 88 is pressed up against the inside of cap 92. Extending portion 92 serves as stop means preventing the spool from traveling beyond the point of alignment of the inlet and trough. In the condition shown in FIG. 4, trough 118 of spool 82 is aligned with inlet 116. Fluid is free to flow into or out of first side 62 as actuator 22 moves the control surface, and there is no drag effect as the result of the dead system.

Figure 7:
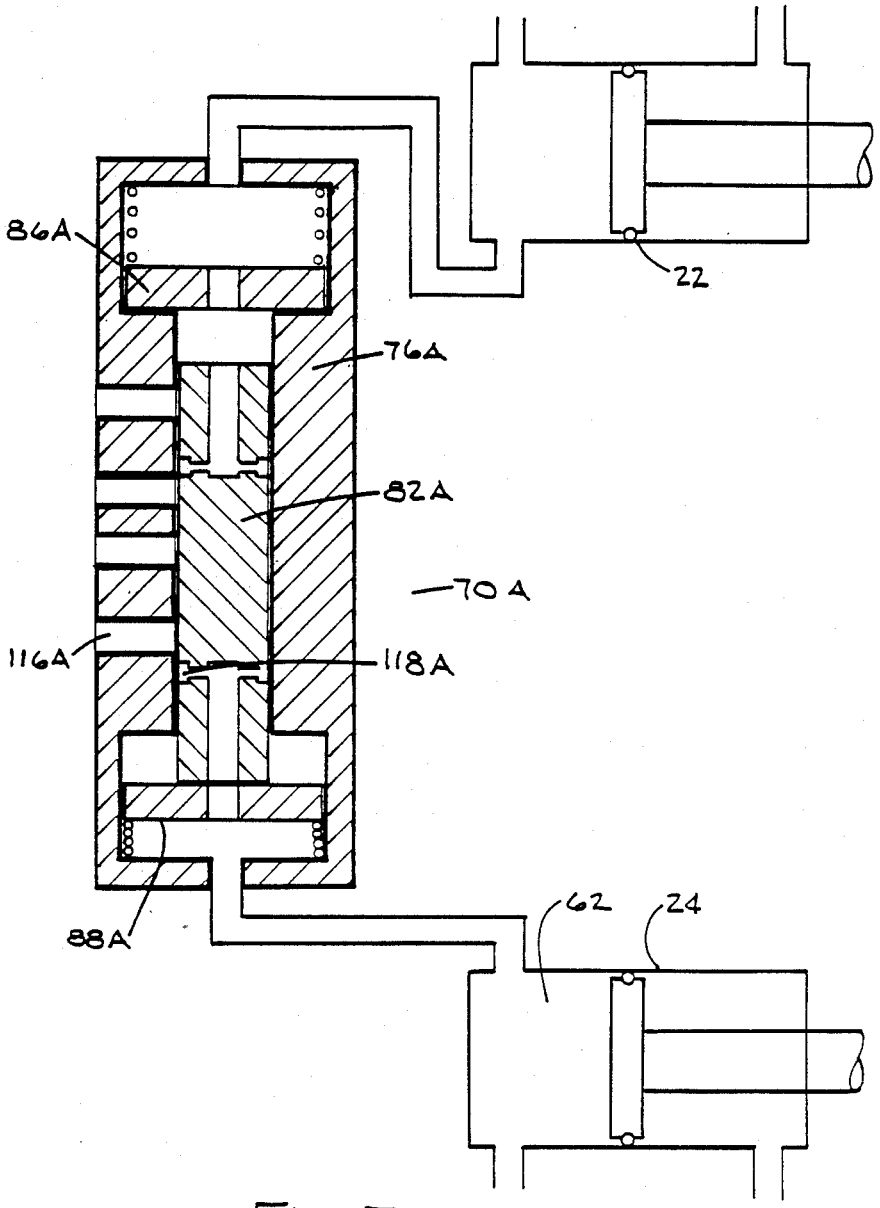
FIG. 7 is a view similar to FIG. 3 showing an alternative embodiment of the pressure equalization valve in an acting condition.

In some circumstances it is desirable to oppose movement of the control surface in the event a hydraulic system fails. In these circumstances the alternative embodiment of the pressure equalization valve shown in FIG. 7 may be used. The system shown in FIG. 7 is similar to FIG. 3 except that pressure equalization valve 70A differs from pressure equalization of 70 in the construction of its cylinders 86A and 88A. Cylinders 86A and 88A do not have extending portions like cylinders 86 and 88. Thus, spool 82A is free to move in sleeve 76A beyond the point of alignment of inlet 116A and trough 118A as shown in FIG. 7. When a hydraulic system fails, pressure equalization valve 70A traps the fluid in the inoperative system causing it to resist movement. Valve 70A is symmetrical, so fluid is trapped in either system in the event of failure.

Although it is rare, tandem hydraulic systems may experience simultaneous failure. When this occurs, there is no means of positioning the control surface. When the system of either embodiment of the invention is employed however, the simultaneous failure of hydraulic supplies 30 and 50 will cause the pressure equalization valve to assume the neutral position due to the absence of pressure at either actuator. With the pressure equalization valve in the neutral position there is no fluid flow through the valve. This will tend to hold the fluid in the actuators and maintain them in their then existing positions. This may avoid sudden erratic maneuvering in some failure situations.

Figure 8:
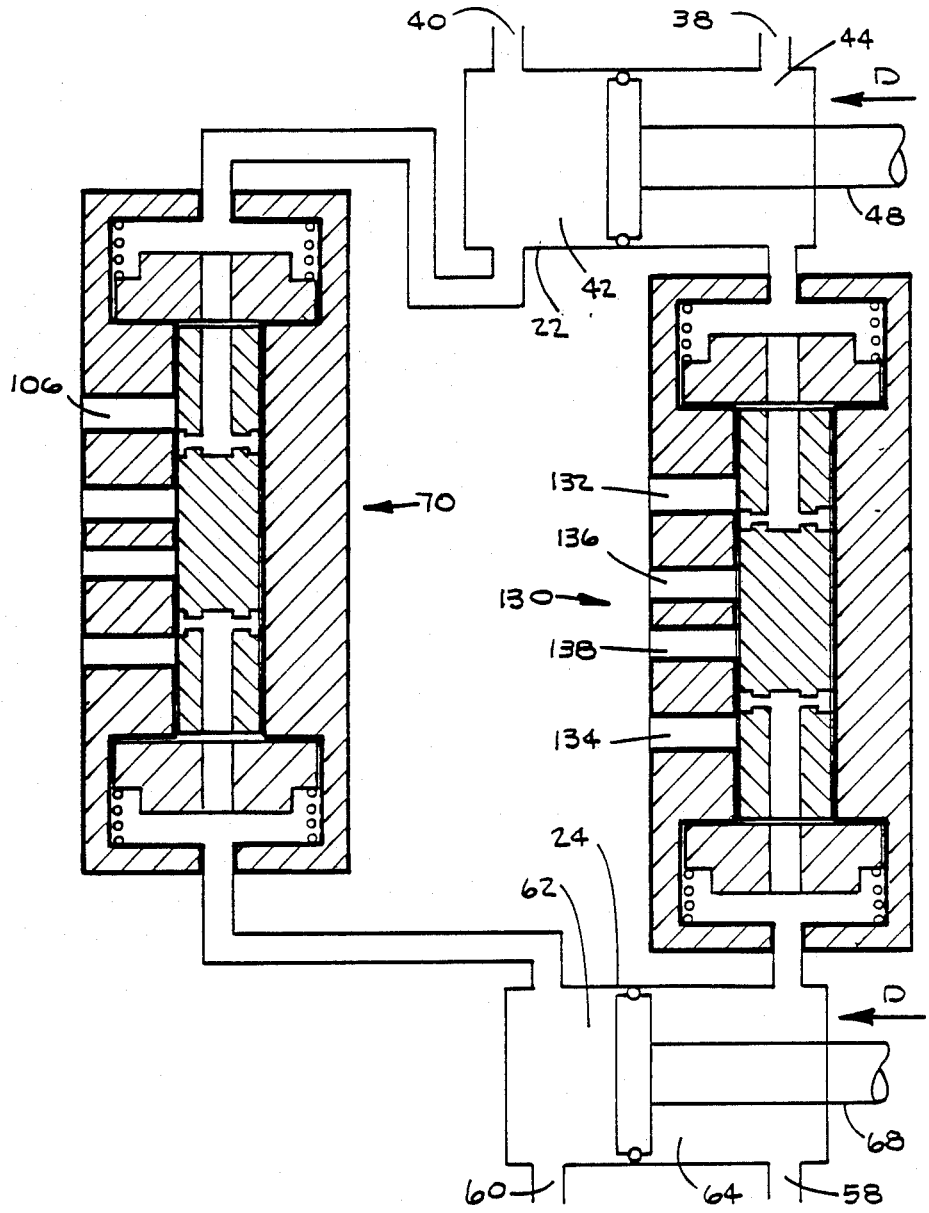
FIG. 8 is a schematic view of a pair of tandem hydraulic actuators operated on parallel hydraulic systems incorporating duel synchronization systems and pressure equalization valves of the present invention.

To minimize force fight it is preferable to use parallel pressure equalization systems on parallel hydraulic actuators. Such parallel systems are shown in FIG. 8 wherein pressure equalization valve 70 is connected with first sides 42, 62 of actuators 22, 24 as in FIG. 3. A second pressure equalization valve 130, identical to pressure equalization valve 70 is shown in fluid connection with second side 44 of actuator 42 and with second side 64 of actuator 24. Pressure equalization valve 130 has a first inlet 132. Inlet 132, like inlet 106 of valve 70, is in connection with supply line 32 of hydraulic supply 30. Valve 130 also has a second inlet 134 which, like inlet 116 of valve 70, is in fluid connection with line 52 of hydraulic supply 50. Valve 130 also has returns 136 and 138 which are connected like returns 124 and 126 respectively of valve 70 and which operate similarly thereto. Pressure equalization valve 130 remedies any imbalance in pressure between second sides 44 and 64 and avoids force fight when the actuators move rams 48 and 68 in the direction of arrow D.

Figure 9:
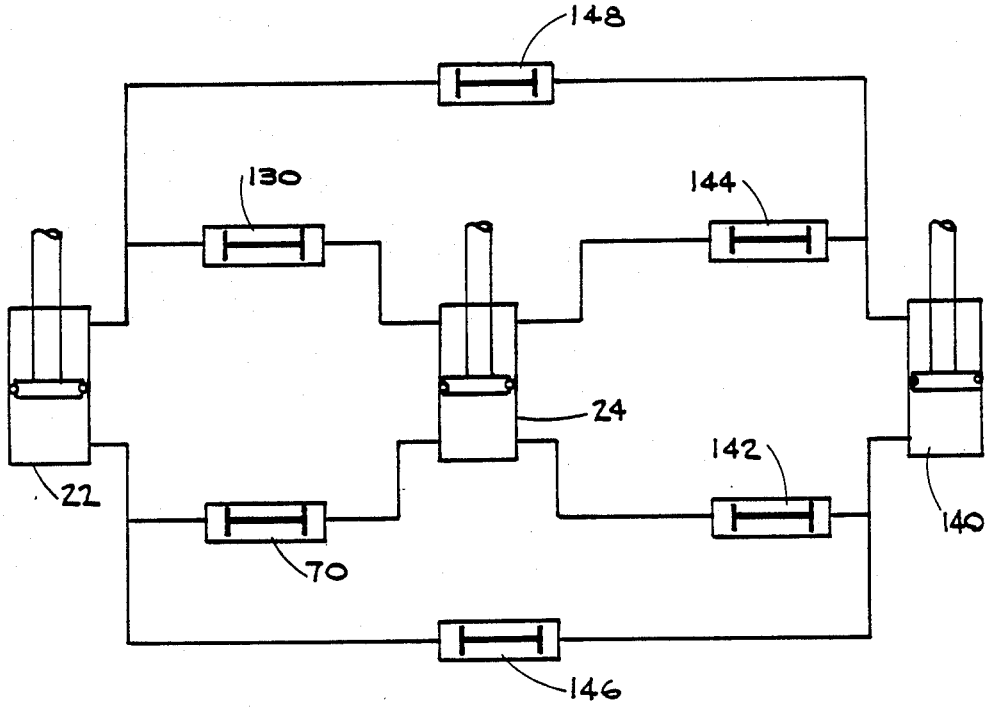
FIG. 9 is a schematic view of a multiple hydraulic actuator system employing a network of synchronization systems and pressure equalization valves of the present invention.

For some control surfaces it is desirable to use more than two hydraulic actuators in parallel. In such cases multiple systems of the present invention can be used to avoid force fight. Such a system employing three parallel actuators is shown in FIG. 9 wherein actuators 22 and 24 act with a third actuator 140. Actuator 140 is operated from a third hydraulic system, not shown. The first sides of actuators 22 and 24 are synchronized by pressure equalization valve 70. Likewise, the second sides of actuators 22 and 24 are synchronized by pressure equalization valve 130. The first and second sides of actuators 24 and 140 are similarly synchronized by a pair of pressure equalization valves 142 and 144 respectively. In order to avoid imbalance between actuators 22 and 140, a third pair of pressure equalization valves 146, 148 are used to equalize pressure between their first and second sides. Networks of synchronization systems of the present invention like those shown in FIG. 9, can be further expanded to synchronize additional hydraulic actuators operating in parallel on aircraft control surfaces.

Those skilled in the art will understand that the principles of the present invention may be applied to systems of parallel actuators supplied from a single hydraulic supply. This may be done by connecting both of the inlets of the foregoing embodiments of the pressure equalization valve to the single supply. In the alternative, a pressure equalization valve may be used that has a single inlet in its sleeve and which has a spool with sufficient travel to allow the first and second fluid passage means to align with the single inlet.

In the foregoing description, certain items have been used for brevity, clarity and understanding. However, no unnecessary limitations are to be implied therefrom because such terms are for descriptive purposes and intended to be broadly construed. Moreover, the descriptions and illustrations are by way of examples and the invention is not limited to the details shown or described.

Having described the features, discoveries and principles of the invention, the manner in which it is constructed and operated, and the advantages and useful results obtained, the new and useful structures, devices, elements, arrangements, parts, combinations, systems, equipment, operations and relationships are set forth in the appended claims.

I claim:

1. A system for reducing force fight between hydraulic actuators acting in parallel to position a control surface of an aircraft, said actuators being operated on separate hydraulic circuits to provide redundancy, comprising:

a first hydraulic actuator and a second hydraulic actuator each of said actuators having a first side and a second side, fluid pressure being applied to said first sides of said actuators to move said control surface in a first direction, said first actuator in connection with a first hydraulic circuit and said second actuator in connection with a second hydraulic circuit independent of said first hydraulic circuit;

a first hydraulic supply means for supplying hydraulic pressure in said first hydraulic circuit;

first hydraulic control means in said first hydraulic circuit in fluid connection with said first supply means and said first actuator for controlling pressure applied on said first side of said first actuator;

a second hydraulic supply means for supplying hydraulic pressure in said second hydraulic circuit;

second hydraulic control means in said second hydraulic circuit in fluid connection with said second supply means and said second actuator for controlling pressure applied on said first side of said second actuator;

a pressure equalization valve comprising:

a body;

a sleeve within said body;

a spool mounted for longitudinal movement in said sleeve, said spool having a first end and a second end;

center biasing means for biasing said spool to a neutral position in said sleeve;

closure means for closing the ends of said sleeve, a first compartment in said sleeve defined by said first end of said spool and said closure means, and a second compartment in said sleeve defined by said second end of said spool and said closure means;

a first inlet in said sleeve;

first fluid passage means in said spool for passing fluid from said first inlet to said first compartment when said first inlet and said first fluid passage means are in alignment, said first fluid passage means located distally of said first inlet when said spool is in the neutral position;

a second inlet is said sleeve; and second fluid passage means in said spool for passing fluid from said second inlet to said second compartment when said second inlet and said second fluid passage means are in alignment, said second fluid passage means located distally of said second inlet when said spool is in the neutral position;

first fluid connecting means for connecting said first side of said first actuator and said first compartment of said valve;

second fluid connecting means for connecting said first hydraulic supply means to said first inlet of said valve;

Third fluid connecting means for connecting said first side of said second actuator and said second compartment of said valve; and fourth fluid connecting means for connecting the second hydraulic supply means to said second inlet of said valve;

whereby an imbalance in the fluid pressures on said first sides of said actuators causes the spool of said valve to move from the neutral position to a position wherein an inlet and fluid passage means are in alignment (and fluid flows from said hydraulic supply means through said valve to an actuator having a lower pressure) enabling fluid to be delivered through said valve to an actuator having a lower pressure to eliminate said imbalance.

2. The system according to claim 1, said pressure equalization valve further comprising stop means for limiting longitudinal movement of said spool in a first direction to a point of alignment of said first inlet and said first fluid passage means, and in a second opposed direction to a point of alignment of said second inlet and said second fluid passage means.

3. The system according to claim 1, said pressure equalization valve further comprising:

a first outlet in said sleeve, said first outlet proximal but not in fluid connection with said first fluid passage means when the spool is in the neutral position;

a second outlet in said sleeve, said second outlet proximal but not in fluid connection with said second fluid passage means when the spool is in the neutral position;

a first return means for returning fluid from said first outlet to said first hydraulic supply means; and a second return means for returning fluid from said second outlet to said second hydraulic supply means.

4. The system according to claim 3 said pressure equalization valve further comprising:

a first cylinder mounted for movement in said first compartment, said cylinder adjacent the first end of said spool when said spool is in the neutral position, said cylinder including means for passing fluid therethrough; and a second cylinder mounted for movement in said second compartment, said cylinder adjacent the second end of said spool when the spool is in the neutral position, said cylinder including means for passing fluid therethrough.

5. The system according to claim 4 wherein said valve sleeve closure means is a pair of cap portions at the ends of said sleeve.

6. The system according to claim 5 wherein said center biasing means of said valve is a pair of opposed coil springs, a spring acting longitudinally in each of said first and second compartments against said first and second cylinders.

7. The system according to claim 6 wherein said first fluid passage means comprises:

a first circumferential trough in said spool, a first longitudinal hole extending through said spool from said first end to a point adjacent to said first trough, said first longitudinal hole in fluid communication with said first compartment, and at least one first radial hole from said first trough to said first longitudinal hole;

and wherein said second fluid passage means comprises:

a second circumferential trough on said spool, a second longitudinal hole extending through said spool from said second end to a point adjacent said second trough, said second longitudinal hole in fluid communication with said second compartment, and at least one second radial hole from said second trough to said second longitudinal hole.

8. The system according to claim 7 wherein said spool is moveable longitudinally in a first direction beyond a point of alignment of said first inlet and first circumferential trough and in a second direction beyond a point of alignment of said second inlet and said second circumferential trough, whereby loss of pressure in said first hydraulic circuit causes said spool to move in a first direction beyond said point of alignment for said first inlet to retain fluid in said first actuator and whereby loss of pressure in said second hydraulic circuit causes said spool to move in a second direction beyond said point of alignment for said second inlet to retain fluid in said second actuator.

9. The system according to claim 8 wherein said first and second actuators are hydraulic cylinders.

10. The system according to claim 7, said pressure equalization valve further comprising stop means for stopping the longitudinal movement of said spool in a first direction at a first point of alignment where said first circumferential trough is aligned with said first inlet and in a second direction at a second point of alignment where said second circumferential trough is aligned with said second inlet, whereby loss of pressure in said first hydraulic circuit causes said spool to move in a first direction to said first point of alignment to release fluid from said first actuator, and whereby loss of pressure in said second hydraulic circuit causes said spool to move in a second direction to said second point of alignment to release fluid from said second actuator.

11. The system according to claim 9 wherein said first and second actuator are hydraulic cylinders.

12. A pressure equalization valve for equalizing pressure between a first pressurized area and a second pressurized area, said first and second pressurized areas being connected to first and second hydraulic circuits respectively, said valve supplied by first hydraulic pressure supply associated with said first circuit and a second hydraulic pressure supply associated with said second circuit, comprising:

a body;

a sleeve within said body;

a spool mounted for longitudinal movement in said sleeve, said spool having a first end and a second end;

center biasing means for biasing said spool to a neutral position in said sleeve;

closure means for closing the ends of said sleeve, a first compartment of said sleeve, a first compartment in said sleeve defined by said first end of said spool and said closure means and a second compartment in said sleeve defined by said second end of said spool and said closure means;

a first inlet in said sleeve in connection with said first hydraulic supply;

first fluid passage means in said spool for passing fluid from said first inlet to said first compartment when said first inlet and said first fluid passage means are in alignment, said first fluid passage means located distally of said first inlet when said spool is in the neutral position;

a second inlet in said sleeve in connection with said second hydraulic pressure supply;

second fluid passage means in said spool for passing fluid from said second inlet to said second compartment when said second inlet and said second fluid passage means are in alignment, said second fluid passage means located distally of said second inlet when said spool is in the neutral position;

first fluid outlet means for connecting said first compartment with said first pressurized area; and second fluid outlet means for connecting said second compartment with said second pressurized area.

13. The valve according to claim 12 and further comprising:

a first outlet in said sleeve, said first outlet proximal but not in fluid connection with said first fluid passage means when the spool is in the neutral position;

a second outlet in said sleeve, said second outlet proximal but not in fluid connection with said second fluid passage means when the spool is in the neutral position;

a first return means for returning fluid from said first outlet to said first hydraulic supply; and a second return means for returning fluid from said second outlet to said second hydraulic supply.

14. The valve according to claim 13 and further comprising:

a first cylinder mounted for movement in said first compartment, said cylinder adjacent the first end of said spool when said spool is in the neutral position, said cylinder including means for passing fluid therethrough; and a second cylinder mounted for movement in said second compartment, said cylinder adjacent the second end of said spool when said spool is in the neutral position, said cylinder including means for passing fluid therethrough.

15. The valve according to claim 14 wherein said closure means is a pair of cap portions at the end of said sleeve.

16. The valve according to claim 15 wherein said center biasing means is a pair of opposed coil springs, a spring acting longitudinally in each of said first and second compartments against said first and second cylinders.

17. The valve according to claim 16 wherein said first fluid passage means comprises:

a first circumferential trough in said spool, a first longitudinal hole extending through said spool from said first end to a point adjacent said first through, said first longitudinal hole in fluid communication with said first compartment, and at least one first radial hole from said first trough to said first longitudinal hole;

and wherein said second fluid passage means comprises:

a second circumferential trough in said spool, a second longitudinal hole extending through said spool from said second end to a point adjacent said second trough, said second longitudinal hole in fluid communication with said second compartment, and at least one second radial hole from said second trough to said second longitudinal hole.

18. The valve according to claim 17 and further comprising:

stop means for limiting longitudinal movement of said spool in a first direction to a point of alignment of said first inlet and said first fluid passage means and in a second opposed direction to a point of alignment of said second inlet and said second fluid passage means.

19. A pressure equalization valve for equalizing pressure between a first pressurized area and a second pressurized area, said valve supplied by first hydraulic supply, comprising:

a body;

a sleeve within said body;

a spool mounted for movement in said sleeve, said spool having a first end and a second end;

center biasing means for biasing said spool to a neutral position in said sleeve;

closure means for closing said sleeve, a first compartment in said sleeve defined by said first end of said spool and said closure means and a second compartment defined by said second end of said spool and said closure means;

a first inlet in said sleeve in connection with said first hydrraulic supply;

first fluid passage means in said spool for passing fluid from said first inlet to said first compartment when said first inlet and first fluid passage means are in alignment, said first fluid passage means located in a first direction distally of said first inlet when said spool is in the neutral position;

second fluid passage means in said spool for passing fluid from said first inlet to said second compartment when said first inlet and said second fluid passage means are in alignment, said second fluid passage means located in a second opposed direction distally of said first outlet when said spool is in the neutral position;

first fluid outlet means connecting said first compartment with said first pressurized area;

second fluid outlet means for connecting said second compartment with said second pressurized area.

20. A pressure equalization valve for equalizing pressure between a first pressurized area and a second pressurized area, said valve supplied by a first hydraulic supply, comprising:

a body;

a sleeve within said body;

a spool mounted for movement in said sleeve, said spool having a first end and a second end;

center biasing means for biasing said spool to a neutral position in said sleeve;

closure means for closing said sleeve, a first compartment in said sleeve defined by said first end of said spool and said closure means and a second compartment defined by said second end of said spool and said closure means;

a first inlet in said sleeve in connection with said first hydraulic supply;

first fluid passage means in said spool for passing fluid from said first inlet to said first compartment when said first inlet and first fluid passage means are in alignment, said first inlet when said spool is in the neutral position;

second fluid passage means in said spool for passing fluid from said first inlet to said second compartment when said first inlet and said second fluid passage means are in alignment, said second fluid passage means located in a second opposed direction distally of said first outlet when said spool is in the neutral position;

first fluid outlet means connecting said first compartment with said first pressurized area;

second fluid outlet means for connecting said second compartment with said second pressurized area;

a first outlet in said sleeve, said first outlet proximal but not in fluid connection with said first fluid passage means when the spool is in the neutral position;

a second outlet in said sleeve, said second outlet proximal but not in fluid connection with said second fluid passage means when the spool is in the neutral position;

a first return means for returning fluid from said first outlet to said hydraulic supply; and a second return means for returning fluid from said second outlet to said first hydraulic supply.

21. The valve according to claim 14 and further comprising:

a first cylinder mounted for movement in said first compartment, said cylinder adjacent the first end of said spool when said spool is in the neutral position, said cylinder including means for passing fluid therethrough; and a second cylinder mounted for movement in said second compartment, said cylinder adjacent the second end of said spool when said spool is in the neutral position, said cylinder including means for passing fluid therethrough.

22. The valve according to claim 15 wherein said closure means is a pair of cap portions at the ends of said sleeve.

23. The valve according to claim 16 wherein said center biasing means is a pair of opposed coil springs, a spring acting longitudinally in each of said first and second compartments against said first and second cylinders.

24. The valve according to claim 17 wherein said first fluid passage means comprises:

a first circumferential trough in said spool, a first longitudinal hole extending through said spool from said first end to a point adjacent said first trough, said first longitudinal hole in fluid communication with said first compartment, and at least one first radial hole from said first trough to said first longitudinal hole;

and wherein said second fluid passage means comprises:

a second circumferential trough on said spool, a second longitudinal hole extending through said spool from said second end to a point adjacent said second trough, said second longitudinal hole in fluid communication with said second compartment, and at least one second radial hole from said second trough to said second longitudinal hole.

25. The valve according to claim 18, and further comprising:

stop means for limiting longitudinal movement of said spool in a first direction to a point of alignment of said first inlet and said first fluid passage means, and in a second opposed direction to a point of alignment of said second inlet and said second fluid passage means.

26. A system for reducing force fight between hydraulic actuators acting in parallel to position a control surface of an aircraft, comprising:

a first hydraulic actuator and a second hydraulic actuator each of said actuators having a first side and a second side, fluid pressure being applied to said first sides of said actuators to move said control surface in a first direction;

a hydraulic supply means for supplying hydraulic pressure;

first hydraulic control means in fluid connection with said first supply means and said first actuator for controlling pressure applied on said first side of said first actuator;

second hydraulic control means in fluid connection with said hydraulic supply means and said second actuator for controlling pressure applied on said first side of said second actuator;

a pressure equalization valve comprising;

a body;

a sleeve within said body;

a spool mounted for longitudinal movement in said sleeve, said spool having a first end and a second end;

center biasing means for biasing said spool to a neutral position in said sleeve;

closure means for closing the ends of said sleeve, a first compartment in said sleeve defined by said first end of said spool and said closure means and a second compartment in said sleeve defined by said second end of said spool and said closure means;

a first inlet in said sleeve;

first fluid passage means in said spool for passing fluid from said first inlet to said first compartment when said first inlet and said first fluid passage means are in alignment, said first fluid passage means located distally of said first inlet when said spool is in the neutral position;

a second inlet in said sleeve; and second fluid passage means in said spool for passing fluid from said second inlet to said second compartment when said second inlet and said second fluid passage means are in alignment, said second fluid passage means located distally of said second inlet when said spool is in the neutral position;

first fluid connecting means for connecting said first side of said first actuator and said first compartment of said valve;

second fluid connecting means for connecting said hydraulic supply means to said first inlet of said valve;

third fluid connecting means for connecting said first side of said second actuator and said second compartment of said valve; and fourth fluid connecting means for connecting said hydraulic supply means to said second inlet of said valve;

whereby an imbalance in the fluid pressures on said first sides of said actuators causes the spool of said valve to move from the neutral position to a position wherein an inlet and fluid passage means are in alignment enabling fluid to be delivered from said hydraulic supply means through said valve to an actuator having a lower pressure to eliminate said imbalance.

* * * * *

UNITED STATES PATENT AND TRADEMARK OFFICE

CERTIFICATE OF CORRECTION

PATENT NO. : 4,825,748

DATED : May 2, 1989

INVENTOR(S) : Shih Y. Sheng

It is certified that error appears in the above-identified patent and that said Letters Patent is hereby corrected as shown below:

Column 11, line 2, claim 1, delete "(and fluid flows from said hydraulic supply means through said valve to an actuator having a lower pressure)".

Column 14, line 50, claim 20, after "first" insert --fluid passage means located in a first direction distally of said first--.

Signed and Sealed this

Ninth Day of January, 1990

*Attest:*

JEFFREY M. SAMUELS

*Attesting Officer* *Acting Commissioner of Patents and Trademarks*